United States Patent [19]

Nelson

[11] 3,984,107

[45] Oct. 5, 1976

[54] GAME MASTER BOARD

[76] Inventor: Carl C. Nelson, P.O. Box 1113, Juneau, Alaska 99802

[22] Filed: Dec. 13, 1974

[21] Appl. No.: 532,473

[52] U.S. Cl. ..... 273/135 B; 40/109; 273/136 R

[51] Int. Cl.[2] ..... A63F 3/06

[58] Field of Search ..... 273/135 R, 136 R, 135 B, 273/135 BC, 148 A, 138 R, 152 R, 130 B; 35/17, 7 R, 21, 27, 73; 40/109, 63 R, 64 R, 124.2

[56] References Cited

UNITED STATES PATENTS

| | | | |
|---|---|---|---|
| 887,342 | 5/1908 | McLane | 35/27 |
| 2,340,153 | 1/1944 | Stewart | 40/107 |
| 2,499,329 | 2/1950 | Potter | 40/109 |
| 2,610,855 | 9/1952 | Spiller | 273/135 B |
| 2,923,070 | 2/1960 | Resnick | 35/7 R |
| 3,149,842 | 9/1964 | Cirrincione | 273/136 C |
| 3,207,421 | 9/1965 | Hunger et al. | 40/124.2 |
| 3,411,221 | 11/1968 | Clark | 35/9 R |
| 3,603,592 | 9/1971 | Bury | 273/135 B |
| 3,665,618 | 5/1972 | Hahn | 273/135 BC |
| 3,732,629 | 5/1973 | Spitzner | 273/135 BC |
| 3,873,095 | 3/1975 | Nehre | 273/130 B |

*Primary Examiner*—Richard C. Pinkham
*Assistant Examiner*—Harry G. Strappello
*Attorney, Agent, or Firm*—Clarence A. O'Brien; Harvey B. Jacobson

[57] ABSTRACT

A master board assembly for facilitating the playing of games such as bingo, and the like, has a plurality of game indicating cards selectively mountable on a frame. The latter includes a substantially planar member provided with a plurality of spaced openings with which cooperates indicia on a selected card mounted on the frame for indicating the game being played, and a panel attached to the planar member at parallel edges of same for forming a pocket arranged for holding a selected card.

3 Claims, 4 Drawing Figures

GAME MASTER BOARD

BACKGROUND OF THE INVENTION

1. Field of the Invention

This invention relates generally to a master board assembly, and particularly to a master board assembly arrangeable in view of a large group of game players for facilitating playing of such games as bingo, and the like.

2. Description of the Prior Art

Games such as bingo have long been popular pastimes, and are frequently used by various non-profit organizations as an agreeable manner of raising funds. While these games were originally played only to cover, for example, a single row, column, or diagonal of the playing board, or to cover the entire playing board, the trend is to develop games which require various recognizable patterns, such as letters of the alphabet, to be formed on the playing board in order to win the game. This trend is intended to maintain interest in these games. The problem arises, however, when playing such games with a large number of persons assembled in a hall, and the like, of keeping the players informed as to what game is being played. If the players are not so informed as to the specific game being played, many players forget what openings on their playing boards are to be covered in order to win the game, and much confusion results.

Prior patents believed pertinent to the present invention are as follows:

| | | |
|---|---|---|
| 2,230,178 | G. A. Campbell | Jan. 28, 1941 |
| 2,470,310 | H. Heyman | May 17, 1949 |
| 3,665,618 | M. K. Hahn | May 30, 1972 |

SUMMARY OF THE INVENTION

It is an object of the present invention to provide a master board assembly permitting players of a game such as bingo to be advised of the openings on the player's playing boards that must be covered in order to win the game.

It is another object of the present invention to provide a master board assembly that will quickly and easily indicate to a large number of players in a hall, and the like, a specific game being played.

It is still another object of the present invention to provide a master board assembly which may be quickly and easily set up to indicate a particular game being played.

These and other objects are achieved according to the present invention by providing a master board assembly having: a plurality of game indicating cards, each card including thereon indicia which indicates a particular game being played; and a frame including a substantially planar member provided with a plurality of spaced openings, and further including retaining structure for holding a selected one of the game indicating cards on the frame, the indicia of the selected one of the game indicating cards being arranged cooperating with the openings in the planar member for indicating the game being played.

Preferably, the openings provided in the planar member include a plurality of openings uniformly spaced in a substantially rectangular grid, and a single opening arranged adjacent the grid. Advantageously, the single opening, which will be employed to display indicia descriptive of the game being played, will be arranged so as to be directly beneath the rectangular grid when the frame is held in an orientation necessary for reading the descriptive indicia.

The frame may advantageously further include a panel arranged coextensive with the planar member, with the panel and planar member being connected together along a pair of spaced, parallel edges for creating a pocket which forms the card retaining structure.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a schematic representation showing several possible patterns that may be employed for forming the indicia on game indicating cards according to the present invention.

DESCRIPTION OF THE PREFERRED EMBODIMENT

Figure 1:
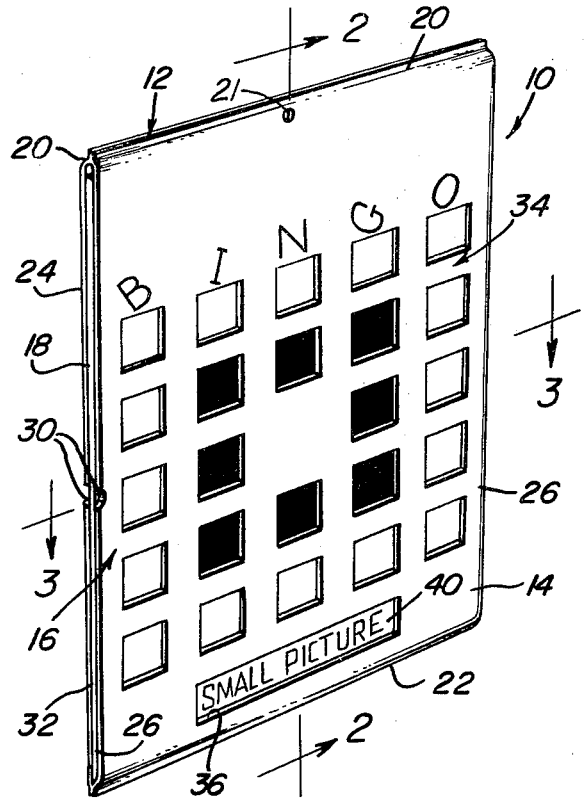
FIG. 1 is a perspective view showing master board assembly according to the present invention.
Figure 2:
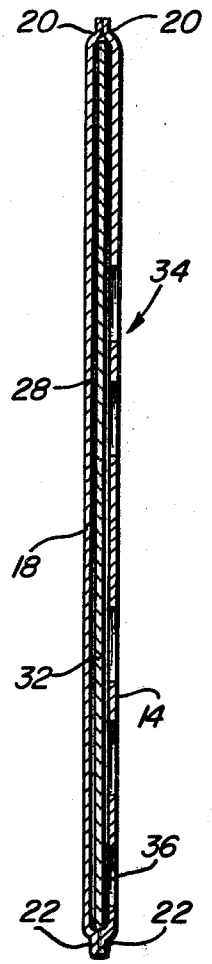
FIG. 2 is a sectional view taken generally along the line 2—2 of FIG. 1.
Figure 3:
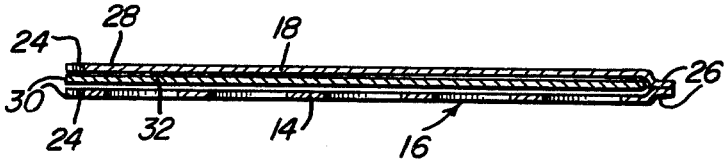

Referring now more particularly to FIGS. 1 through 3 of the drawings, a master board assembly 10 according to the present invention includes a frame 12 partially formed by a substantially planar member 14 provided with a plurality of spaced openings 16. As will be appreciated, frame 12 should be of sufficient size as to be visible to all game players assembled in a large hall, and the like, when played in plain view of the game players.

Frame 12 advantageously further includes a panel 18 arranged coextensive with planar member 14. The panel 18 and member 14 are preferably substantially rectangular in plan, with each of the panel 18 and member 14 having two pairs of spaced, parallel edges 20, 22 and 24, 26. In this manner, panel 18 and member 14 can be connected together along, for example, edges 20 and 22 for creating a pocket 28 forming retaining structure for holding a selected one of a plurality of game indicating cards to be described below on the frame. Aperture 21 is provided at substantially the mid-point of sealed edge 20.

One edge, edge 26 being illustrated, of the other pair of edges 24, 26 is advantageously sealed in a conventional manner similar to the manner in which edges 20 and 22 are sealed. The other edge, edge 24 being illustrated, of the pair of edges 24, 26 is left open for permitting insertion into and removal from pocket 28 of a selected game indicating card. Opposed recesses 30 are provided on edges 24 for facilitating removal of a game card, which is generally designated by the reference numeral 32, from pocket 28.

As indicated above, assembly 10 is provided with a plurality of game indicating cards 32, with each card 32 including thereon indicia which indicates a particular game being played. As will be appreciated, the number of cards 32 will correspond to the number of games devised to be played.

Openings 16 provided in member 14 are advantageously divided into a plurality of openings uniformly spaced in a substantially rectangular grid 34 and into a single opening 36 arranged adjacent grid 34. The plurality of openings 16 which form grid 34 are advantageously substantially square in configuration when member 14 is viewed in plan, and opening 36 advantageously has an elongated, rectangular configuration as illustrated. Further, grid 34 is advantageously symmetrical and has a solid center portion, with those openings 16 which form grid 34 being arranged symmetrically about the solid center portion.

Figure 4:
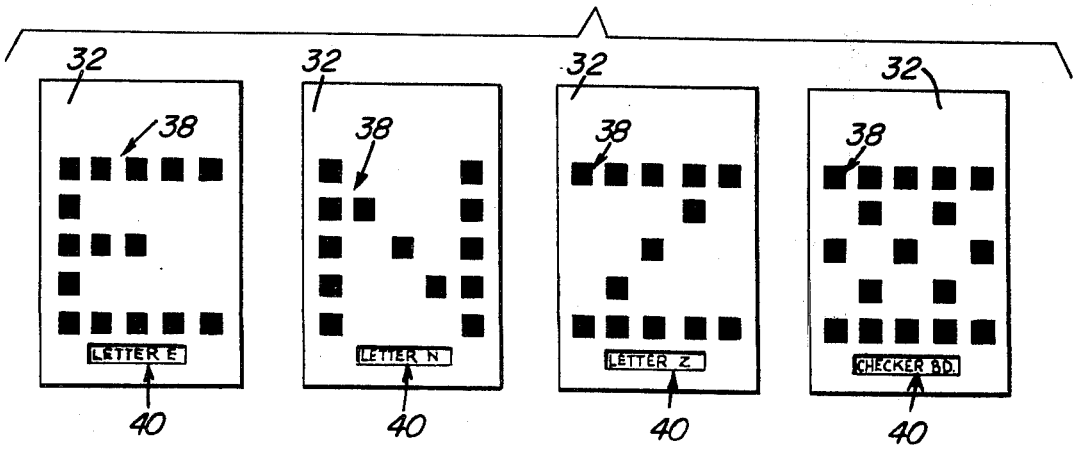
FIG. 4 is a sectional view taken generally along the line 3—3 of FIG. 1.

As will be appreciated, the indicia provided on cards 32 advantageously cooperates with the openings 16 provided in member 14 for indicating the game being played. Toward this end, part of the indicia on each card 32 includes markings 38 arranged for filling predetermined ones of the portion of opening 16 forming grid 34, and further includes descriptive markings 40 arranged cooperating with the single opening 36 for describing the game being played. FIG. 4 shows four examples of markings 38 and 40 that may be employed to play various games of the generic game bingo. For example, the letter games E, N, Z, and the checkboard pattern are shown in FIG. 4, while other possible patterns include the diamond, square, and so forth.

As will be appreciated from the above description and from the drawings, a master board assembly 10 according to the present invention eliminates time and confusion among game players as the players are able to observe what particular game of bingo is being played. Further, the game may be quickly and easily changed merely by removing one card 32 from pocket 28 of frame 12 and inserting another card 32 into the pocket.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A master board assembly for facilitating the playing of games, comprising, in combination: means for displaying the type of Bingo game being played to a group of players in a large assembly hall in order to eliminate confusion among the players, including; a plurality of very large Bingo game indicating cards suitable for viewing from the rear of a large hall, each card indicating thereon indicia which indicates a particular type of Bingo game being played; and a corresponding very large frame including a substantially planar member provided with a plurality of spaced openings, and further including retaining means for holding a selected one of the very large game indicating cards on the frame at a time, the indicia of the selected one of the game indicating cards being arranged cooperating with the openings in the planar member for indicating to players in the large hall the game being played, the openings provided in the planar member including a portion of the openings uniformly spaced in a substantially rectangular grid and a single one of the openings arranged adjacent the grid, and the indicia on each of the game indicating cards including markings for filling predetermined ones of the plurality of openings, and further includes descriptive markings cooperating with the single one of the openings for describing the game being played, the portion of the openings forming the grid are substantially square in configuration when viewed in plan, the single one of the openings having an elongated, rectangular configuration when viewed in plan, the grid is symmetrical and has a solid center portion with the portion of the openings forming the grid being arranged symmetrically about the solid center portion, and the frame further includes a panel arranged coextensive with the planar member, the panel and planar member being substantially rectangular in plan, each of the panel and planar member having two pairs of spaced, parallel edges, with the panel and planar member being connected together along one of the pair of the edges for creating a pocket forming the retaining means.

2. A structure as defined in claim 1, wherein one edge of the other pair of edges is sealed, the other edge of the other pair of edges being open for permitting insertion into and removal from the pocket of the selected one of the game indicating cards, and opposed semi-circular recesses being provided on the other edges of the other pair of edges for facilitating removal from the pocket of the selected one of the game indicating cards.

3. A structure as defined in claim 2, wherein one of the sealed pair of edges is provided with an aperture at substantially the midpoint thereof.

* * * * *